US009210511B2

(12) United States Patent
Yi

(10) Patent No.: US 9,210,511 B2
(45) Date of Patent: Dec. 8, 2015

(54) MICRO-ELECTROACOUSTIC DEVICE

(71) Applicant: Shao Yi, Shenzhen (CN)

(72) Inventor: Shao Yi, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 14/083,392

(22) Filed: Nov. 18, 2013

(65) Prior Publication Data

US 2014/0140543 A1 May 22, 2014

(30) Foreign Application Priority Data

Nov. 16, 2012 (CN) ..... 2012 2 0609349 U

(51) Int. Cl.

| | |
|---|---|
| ***H04R 7/20*** | (2006.01) |
| ***H04R 7/12*** | (2006.01) |
| ***H04R 7/06*** | (2006.01) |
| ***H04R 31/00*** | (2006.01) |

(52) U.S. Cl.

CPC .. *H04R 7/20* (2013.01); *H04R 7/06* (2013.01); *H04R 7/127* (2013.01); *H04R 31/006* (2013.01); *H04R 2231/003* (2013.01); *H04R 2307/207* (2013.01); *H04R 2499/11* (2013.01)

(58) Field of Classification Search

CPC ..... H04R 7/06; H04R 7/10; H04R 7/12; H04R 7/122; H04R 7/125; H04R 7/127; H04R 7/16; H04R 7/18; H04R 7/20; H04R 7/22; H04R 31/00; H04R 31/003; H04R 31/006; H04R 2207/021; H04R 2231/00; H04R 2231/001; H04R 2231/003; H04R 2307/00; H04R 2307/201; H04R 2307/207

USPC ..... 381/423, 424, 430; 181/171, 172, 164

See application file for complete search history.

(56) References Cited

U.S. PATENT DOCUMENTS

| | | | | |
|---|---|---|---|---|
| 2,234,007 | A * | 3/1941 | Olson et al. | 181/172 |
| 3,684,052 | A * | 8/1972 | Sotome | 381/398 |
| 4,477,699 | A * | 10/1984 | Wada et al. | 381/184 |
| 4,567,327 | A * | 1/1986 | Goossens et al. | 381/185 |
| 5,748,759 | A * | 5/1998 | Croft et al. | 381/398 |
| 5,883,967 | A * | 3/1999 | House | 381/398 |
| 6,160,898 | A * | 12/2000 | Bachmann et al. | 381/425 |
| 6,259,800 | B1 * | 7/2001 | Tagami | 381/412 |
| 6,490,363 | B1 * | 12/2002 | Liu | 381/403 |
| 6,658,129 | B2 * | 12/2003 | D'Hoogh | 381/349 |
| 6,862,361 | B2 * | 3/2005 | Clark et al. | 381/423 |
| 7,185,735 | B2 * | 3/2007 | Sahyoun | 181/157 |
| 7,225,895 | B2 * | 6/2007 | Sahyoun | 181/157 |
| 7,317,810 | B2 * | 1/2008 | Ohashi | 381/421 |
| 7,360,626 | B2 * | 4/2008 | Sahyoun | 181/163 |
| 7,418,107 | B2 * | 8/2008 | Milot et al. | 381/398 |
| 7,428,946 | B2 * | 9/2008 | Honda et al. | 181/171 |

(Continued)

*Primary Examiner* — Curtis Kuntz
*Assistant Examiner* — Joshua Kaufman
(74) *Attorney, Agent, or Firm* — IPro, Inc.; Na Xu

(57) ABSTRACT

A micro-electroacoustic device includes a holder forming a hollow space, a magnetic system received in the hollow space, a vibrating system having a diaphragm and a coil driving the diaphragm for vibrating along a vibrating direction. The diaphragm is assembled with the holder and has an upper edge portion and a lower edge portion connected with the upper edge portion and assembled with the holder. The upper edge portion has a protruding part protruding away from the magnetic system and the lower edge portion has a recessed part recessed towards the magnetic system for supporting the voice coil evenly.

7 Claims, 3 Drawing Sheets

(56) References Cited

U.S. PATENT DOCUMENTS

| | | | | |
|---|---|---|---|---|
| 7,568,552 | B2 * | 8/2009 | Litovsky et al. | 181/171 |
| 7,974,434 | B2 * | 7/2011 | Funahashi | 381/398 |
| 8,073,186 | B2 * | 12/2011 | Milot et al. | 381/398 |
| 8,111,868 | B2 * | 2/2012 | Kaiya | 381/403 |
| 2002/0146145 | A1 * | 10/2002 | James et al. | 381/426 |
| 2004/0213431 | A1 * | 10/2004 | Mello | 381/430 |
| 2005/0078849 | A1 * | 4/2005 | Funahashi et al. | 381/412 |
| 2005/0141746 | A1 * | 6/2005 | Kobayashi et al. | 381/424 |
| 2005/0201588 | A1 * | 9/2005 | Funahashi et al. | 381/423 |
| 2006/0215871 | A1 * | 9/2006 | Funahashi et al. | 381/396 |
| 2006/0245615 | A1 * | 11/2006 | Funahashi | 381/398 |
| 2006/0274914 | A1 * | 12/2006 | Horigome et al. | 381/424 |
| 2006/0285718 | A1 * | 12/2006 | Funahashi | 381/403 |
| 2007/0121995 | A1 * | 5/2007 | Funahashi et al. | 381/433 |
| 2007/0127768 | A1 * | 6/2007 | Horigome et al. | 381/423 |
| 2008/0053745 | A1 * | 3/2008 | Tada et al. | 181/165 |
| 2008/0279414 | A1 * | 11/2008 | Milot et al. | 381/398 |
| 2012/0008816 | A1 * | 1/2012 | Liu et al. | 381/401 |
| 2012/0128195 | A1 * | 5/2012 | Liu et al. | 381/386 |
| 2013/0064413 | A1 * | 3/2013 | Cazes Bouchet | 381/396 |

* cited by examiner

MICRO-ELECTROACOUSTIC DEVICE

FIELD OF THE INVENTION

The present disclosure relates to the art of micro-electroacoustic devices and, particularly to a micro-electroacoustic device having a diaphragm.

DESCRIPTION OF RELATED ART

Generally, an electronic device, such as a mobile phone, uses a micro-electroacoustic device as a sound generator. A typical micro-electroacoustic device includes a holder having a hollow space, a magnetic system received in the hollow space, a diaphragm attached on the holder, and a coil connected with the diaphragm for driving the diaphragm in a vibrating direction. The diaphragm has a central portion, a protruding portion extending from the central portion and protruding forward along the vibrating direction, and a fixing portion extending from the protruding portion and fixed on the holder.

The protruding portion is capable of providing a restoring force when the diaphragm is activated by the coil to vibrate along the vibrating direction repeatedly. Because of the protruding portion protruding forward along the vibrating direction, the restoring force generated by the diaphragm during the vibration approaching the magnetic system is unequal to that generated by the diaphragm during the vibration away from the magnetic system, thereby increasing the sound distortion.

Therefore, it is desirable to provide a micro-electroacoustic device which can overcome the above-mentioned problem.

DETAILED DESCRIPTION OF THE EXEMPLARY EMBODIMENT

Figure 1:
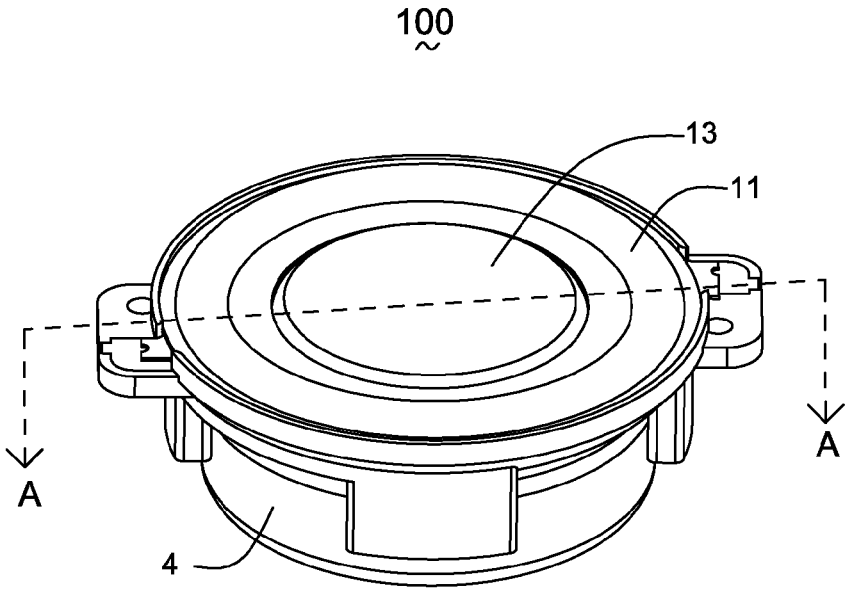
FIG. 1 is an illustrative assembled view of the micro-electroacoustic device in accordance with an exemplary embodiment of the present invention.
Figure 2:
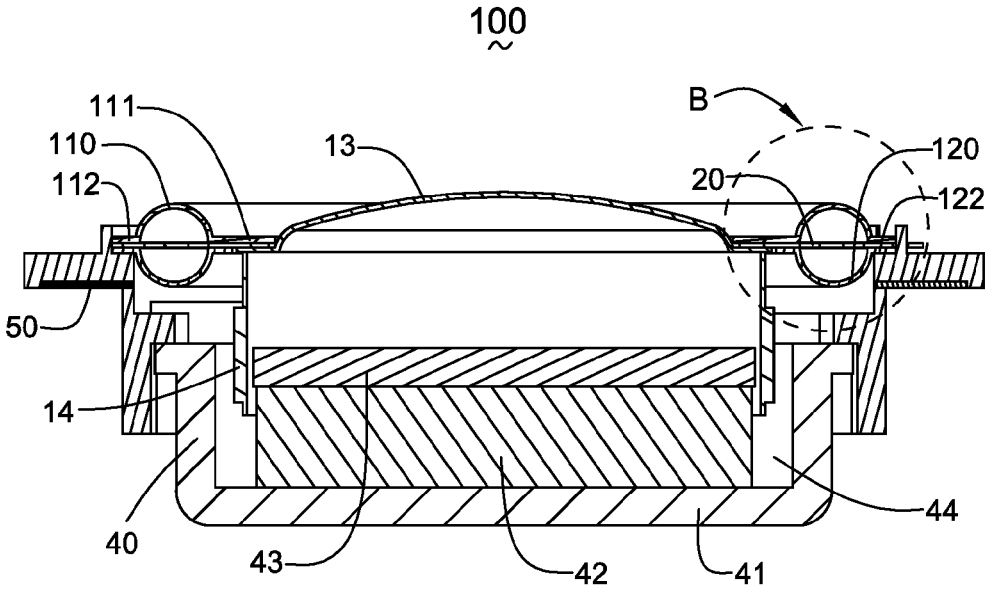
FIG. 2 is a cross-sectional view of the micro-electroacoustic device taken along line A-A in FIG. 1.
Figure 3:
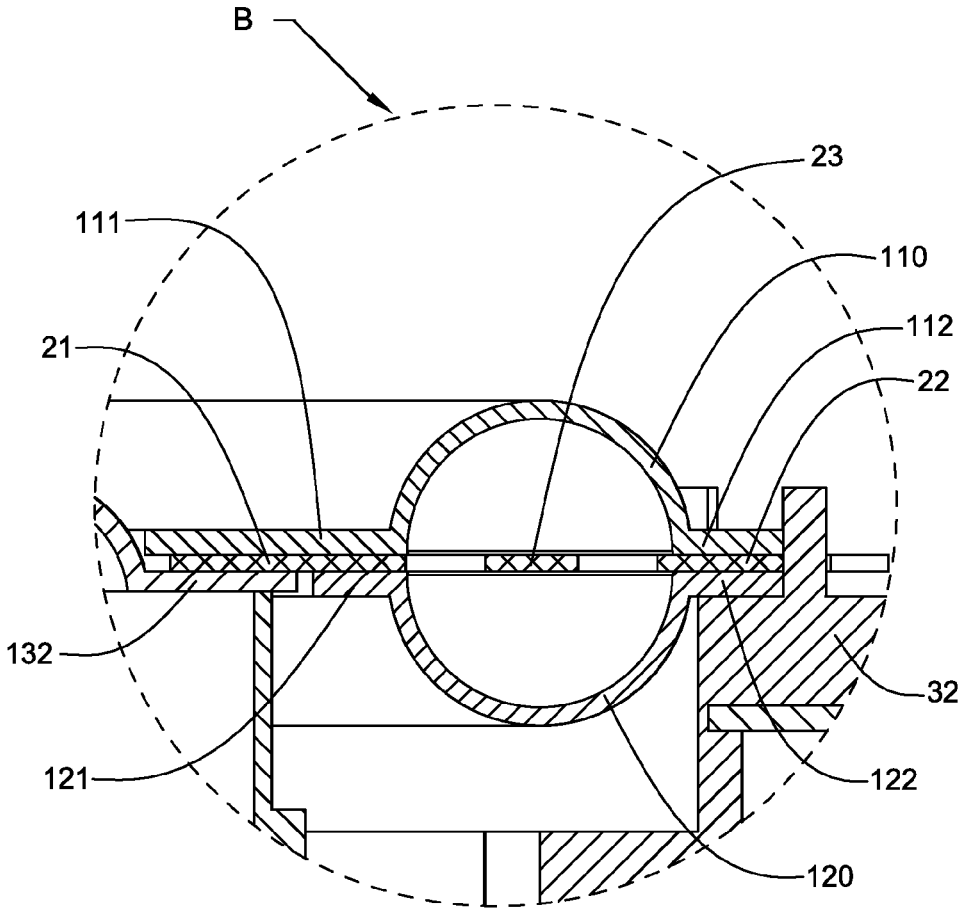
FIG. 3 is an enlarged view of part B in FIG. 2.
Figure 4:
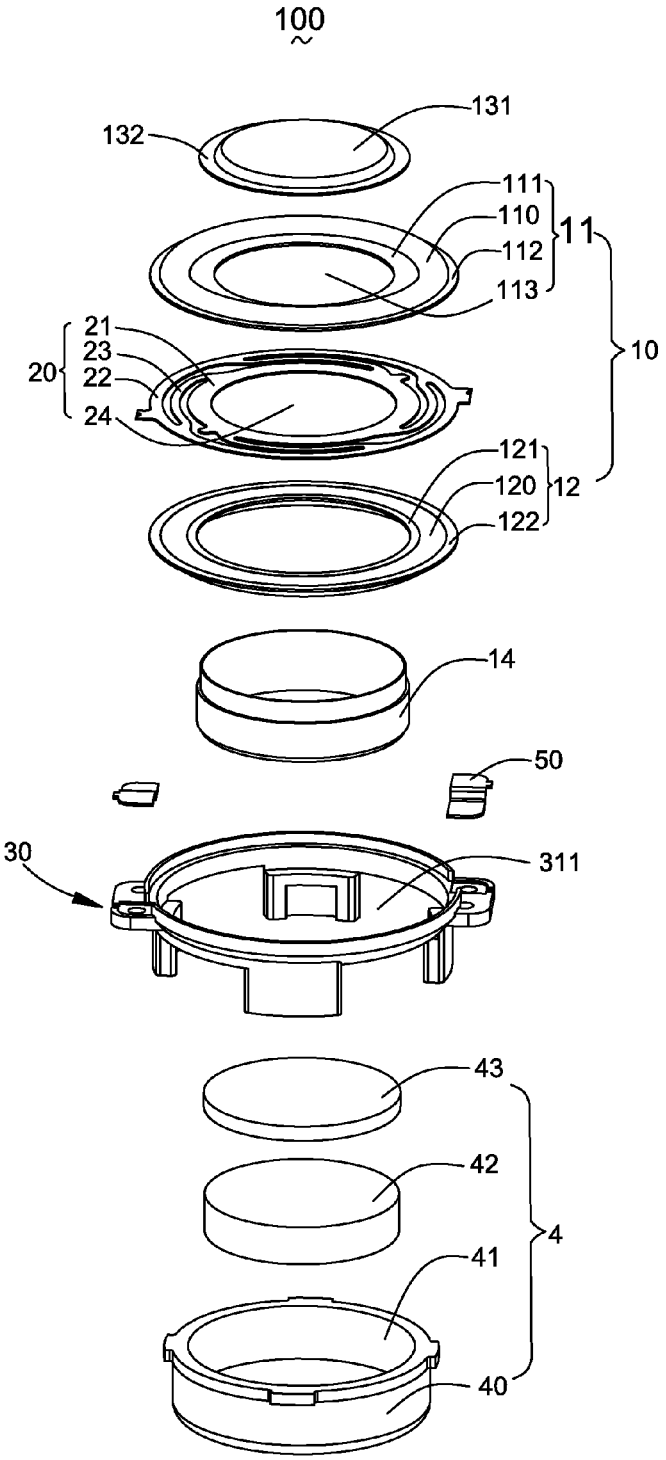
FIG. 4 is an illustrative exploded view of the micro-electroacoustic device in FIG. 1.

Referring to FIGS. 1 through 4, a micro-electroacoustic device 100, in the exemplary embodiment of the present invention, comprises a holder 30 forming a hollow space 311, a magnetic system 4 received in the hollow space 311 and having a magnetic gap 44, a suspension 20 assembled with the holder 30, a diaphragm 10 connected with the suspension 20, a coil 14 having an end suspended in the magnetic gap 44 and an another end directly or indirectly connected with the diaphragm 10 for driving the diaphragm 10 and the suspension 20, and a pair of terminals 50 assembled with the holder 30 for electrically connecting with the suspension 20. When electrified, the coil 14 is forced to move and drive the diaphragm 10 to move upwardly and downwardly along a vibrating direction for producing sound waves.

The magnetic circuit unit 4 comprises a base board 41, a first magnetic conduction member 42 disposed on a center portion of the base board 41, a second magnetic conduction member 40 disposed on a periphery portion of the base board 41 for forming the magnetic gap 44 together with the first magnetic conduction member 42. The base board 41 is made of magnetic conduction materials for effectively conducting magnetic fluxes. At least one of the first and second magnetic conduction members 42, 40 is a permanent magnet. In this embodiment, the first magnetic conduction member 42 is a permanent magnet and the second magnetic conduction 40 is integral with the base board 41 for conducting the magnetic fluxes generated from the first magnetic conduction member 42.

The suspension 20 is a planar sheet and comprises an inner ring portion 21, a central opening 24 surrounded by the inner ring portion 21, an outer ring portion 22 surrounding the inner ring portion 21 and fixed on the holder 30, and a plurality of elastic arms 23 disposed between and connecting the inner ring portion 21 and the outer ring portion 22. The inner ring portion is coplanar with the outer ring portion for reducing the height of the micro-electroacoustic device. A surface of the suspension 20 facing the magnetic system is defined as an upper surface, and another surface of the suspension opposite to the upper surface is defined as a lower surface.

The diaphragm 10 comprises an upper edge portion 11 attached on the upper surface of the suspension 20, a lower edge portion 12 attached on the lower surface of the suspension 20, and a dome part 13 attached on the suspension 20. The upper edge portion 11 comprises a first inner part 111 attached on the upper surface of the inner ring portion 21 of the suspension 20, a through hole 113 surrounded by the first inner part 111, a protruding part 110 extending from the first inner part 111 and protruding far away from the magnetic system 4, and a first outer part 112 extending from the protruding part 110 and being attached on the upper surface of the outer ring portion 22. The lower edge portion 12 comprises a second inner part 121 attached on the lower surface of the inner ring portion 21 of the suspension 20, a recessed part 120 recessed toward the magnetic system 4, and a second outer part 122 extending from the recessed part 120 and being attached on the lower surface of the outer ring portion 22. A protruding direction of the protruding part is opposite to a recessed direction of the recessed part. The protruding part 110 and the recessed part 120 are optionally symmetrical with the suspension for providing a restoring force evenly.

The dome part 13 has a main curved portion 131 protruding forward along the vibrating direction to form an annular bulge and a connecting portion 132 extending from the main curved portion 131. In this embodiment, the connecting portion 131 of the dome part 13 is attached on the lower surface of the inner ring portion 21 of the suspension 20 for supporting the suspension 20 together with the lower edge portion 12, and the main curved portion 131 passes through the central opening 24 and the through hole respectively for increasing the frequency band rang. The voice coil 14 is directly connected with the connecting portion 132 of the dome part 13 for driving the diaphragm 10 rapidly.

In an alternative embodiment, the connecting portion of the dome part is sandwiched between the suspension and the first inner part of the upper edge portion, and the main curved portion is exposed from the through hole of the upper edge portion. The voice coil is directly connected with the suspension or the second inner part of the lower edge part. In another alternative embodiment, the connecting portion of the dome part is directly attached on the upper edge portion and far away from the suspension.

When the diaphragm vibrates along the vibrating direction, the upper edge portion cooperates with the lower edge portion for supporting the voice coil evenly. Thus, the vibrating of the diaphragm is stable and balanced. By means of the micro-electroacoustic device, reliability of products can be improved.

It will be understood that the above particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A micro-electroacoustic device comprising:

a holder forming a hollow space;

a magnetic system received in the hollow space and comprising a magnetic gap;

a vibrating system comprising a diaphragm and a coil driving the diaphragm for vibrating approaching and away from the magnetic system along a vibrating direction, the diaphragm assembled with the holder and comprising:

an upper edge portion having a protruding part protruding in the direction opposite to the magnetic system, a first inner part extending from one end of the protruding part, a through hole surrounded by the first inner part, and a first outer part extending from the other end of the protruding part;

a dome part having a main curve portion passed through the through hole of the upper edge portion and a connecting portion extending from the main curved portion, located below the first inner part of the upper edge portion, and connected with the first inner part of the upper edge portion;

a lower edge portion located below the upper edge portion, the lower edge portion having a recessed part recessed towards the magnetic system, a second inner part extending from one end of the recessed part, and a second outer part extending from the other end of the recessed part; and a suspension connected with the diaphragm and having an inner ring portion, a center opening surrounded by the inner ring portion, and an outer ring portion surrounding the inner ring portion and fixed on the holder, the inner ring portion located between the connecting portion of the dome part and the second inner part of the lower edge and connected with the connecting portion of the dome part and the second inner part of the lower edge, the outer ring portion located between the first and second outer parts and connected with the first and second outer parts.

2. The micro-electroacoustic device as claimed in claim 1, wherein the first inner part is coplanar with the first outer part and the second inner part is coplanar with the second outer part.

3. The micro-electroacoustic device as claimed in claim 1, wherein the protruding part and the recessed part are symmetrical with the suspension.

4. A micro-electroacoustic device comprising:

a holder forming a hollow space;

a magnetic system received in the hollow space and comprising a magnetic gap;

a vibrating system comprising a diaphragm and a coil driving the diaphragm for vibrating approaching and away from the magnetic system along a vibrating direction, the diaphragm assembled with the holder and comprising:

an upper edge portion having a protruding part protruding in the direction opposite to the magnetic system, a first inner part extending from one end of the protruding part, a through hole surrounded by the first inner part, and a first outer part extending from the other end of the protruding part; and a lower edge portion located below the upper edge portion, the lower edge portion having a recessed part recessed towards the magnetic system, a second inner part extending from one end of the recessed part, and a second outer part extending from the other end of the recessed part; and a suspension sandwiched between the upper and lower edge parts for connecting the upper and lower edge parts, and having an inner ring portion, a center opening surrounded by the inner ring portion, and an outer ring portion surrounding the inner ring portion and fixed on the holder, the inner ring portion located between the first and second inner parts and connected with the first and second inner parts, the outer ring portion located between the first and second outer parts and connected with the first and second outer parts;

Wherein the diaphragm further has a dome part having a main curve portion and a connecting portion extending from the main curved portion, the connecting portion of the dome part is sandwiched between the inner ring portion of the suspension and the second inner part of the lower edge portion and connected with the inner ring portion of the suspension and the second inner part of the lower edge portion for supporting the suspension together with the lower edge portion, the main curved portion is passed through the central opening and the through hole respectively for increasing the frequency band range.

5. The micro-electroacoustic device as claimed in claim 4, wherein one end of the voice coil is connected with the connecting portion.

6. The micro-electroacoustic device as claimed in claim 4, wherein the first inner part is coplanar with the first outer part and the second inner part is coplanar with the second outer part.

7. The micro-electroacoustic device as claimed in claim 4, wherein the protruding part and the recessed part are symmetrical with the suspension.

* * * * *